US006088857A

United States Patent [19]

Ogle

[11] Patent Number: 6,088,857

[45] Date of Patent: Jul. 18, 2000

[54] HINGED INNER SPRING MATTRESS AND MANUFACTURING METHOD

[76] Inventor: David D. Ogle, 2006 N. Williams, Santa Ana, Calif. 92705

[21] Appl. No.: 09/111,996

[22] Filed: Jul. 8, 1998

[51] Int. Cl.[7] ..... A47C 17/00

[52] U.S. Cl. ..... 5/722; 5/716; 5/308

[58] Field of Search ..... 5/722, 716, 249, 5/250, 12.1, 308

[56] References Cited

U.S. PATENT DOCUMENTS

| | | | |
|---|---|---|---|
| 149,758 | 4/1874 | Junge | 5/716 |
| 242,364 | 5/1881 | Poole | 5/722 |
| 2,147,348 | 2/1939 | Munson et el. | 5/716 X |
| 2,654,099 | 10/1953 | Ake et al. | 5/722 X |
| 2,956,290 | 10/1960 | Scheinerman | 5/308 |
| 3,249,952 | 5/1966 | Janapol | 5/716 |
| 5,426,796 | 6/1995 | Stanton | 5/12.1 X |
| 5,657,500 | 8/1997 | Messina | 5/722 |

FOREIGN PATENT DOCUMENTS

| | | | |
|---|---|---|---|
| 2489124 | 3/1982 | France | 5/716 |

*Primary Examiner*—Terry Lee Melius
*Assistant Examiner*—James M. Hewitt
*Attorney, Agent, or Firm*—Harold L. Jackson

[57] ABSTRACT

A hingeable inner spring mattress adapted for the marine environment comprises a pair of inner spring base sections with each base section having a top and bottom surfaces and a peripheral side wall. The peripheral side walls of the base sections define corresponding hingeable side walls. A fabric shell encloses the bottoms and side walls of the base sections and forms a hinge along a hinge axis between the hingeable side walls and adjacent the top surfaces of the base sections so that one base section may be pivoted from a normal position wherein the top surfaces of the base sections are coplanar to a retracted position to provide access to an area below the pivoted base section. A hinge line cover sheet of nonstretchable fabric is secured at both ends to the top surfaces of the base sections with a central segment thereof which extends over the hinge axis in tension when the base sections are coplanar. A cover in the form of a quilted fabric, pillow top, etc. may be secured to the upper periphery of the shell to complete the mattress.

16 Claims, 3 Drawing Sheets

HINGED INNER SPRING MATTRESS AND MANUFACTURING METHOD

FIELD OF THE INVENTION

The present invention relates to inner spring mattresses and more particularly to inner spring mattresses designed for use in the marine environment.

DESCRIPTION OF THE PRIOR ART

Mattresses are generally supported above floor level on a frame or other support structure. Storage area is at a premium in marine vessels. For that reason, the support for a mattress often serves not only to position the mattress above the floor, but also as a needed storage area.

A mattress constructed of foam or other lightweight material may be readily moved aside to provide access to such a storage area. However, inner spring mattresses, which are preferred by many boat owners, are more cumbersome to move. Hinged inner spring mattresses have largely solved the problem of providing relatively easy access to such storage areas. However, the prior art hinged inner spring mattresses have created another problem. Due to the tufting inherent in conventional inner spring mattress construction, the line between hinged parts of the mattress is depressed. As a result, the top of the mattress has a line of depression which is unsightly. While a cushion or pillow top made, for example, of foam or quilted fabric, may be placed over the top of the mattress to hide the depression, even limited use of the mattress tends to cause the top cushion to settle into the hinge depression. There is a need for a hinged inner spring mattress which overcomes the above problem.

SUMMARY OF THE INVENTION

A hinged inner spring mattress in accordance with the present invention includes a pair of inner spring base sections with each section having top and bottom surfaces and an outside perimeter. The perimeter of each section includes a vertically oriented hingeable side.

A fabric shell, which encloses the bottom surfaces and the periphery of the base sections, forms a hinge between the base sections along a hinge axis parallel to the hingeable sides and adjacent the top surfaces of the sections. The shell enables one base section to be rotated or pivoted relative to the other base section from a normal position, where the top surfaces are coplanar, to a retracted position wherein a storage area below the pivoted section is rendered accessible.

A sheet of substantially nonstretchable hinge line cover fabric is secured at each end of the top surfaces of the base sections so that a central segment of the cover fabric, which extends over the hinge axis, is placed in tension when the base sections are coplanar. The cover fabric eliminates the unsightly appearance of the hinge line depression. Preferably, a cover, in the form of a pillow top or a quilted layer, is secured to the upper periphery of the shell to complete the enclosure of the base sections.

The present invention may best be understood by reference to the following description taken in conjunction with the drawings where like components are given the same reference numeral.

DESCRIPTION OF THE PREFERRED EMBODIMENT

Figure 1:
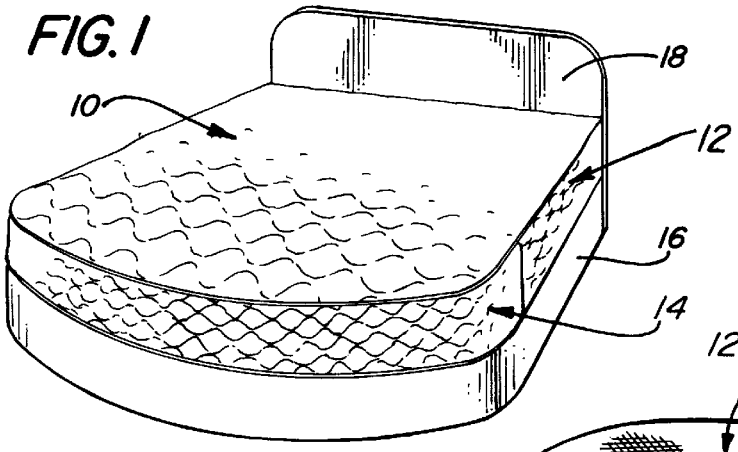
FIG. 1 is a perspective view of a mattress in accordance with the present invention.
Figure 2:
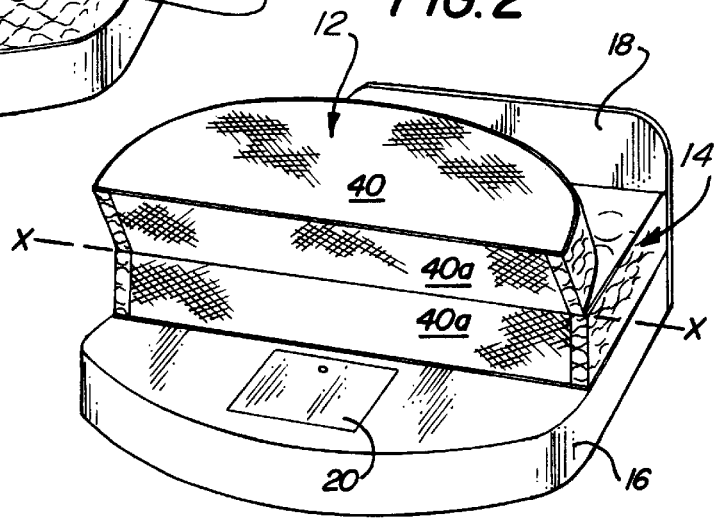
FIG. 2 is a perspective view of the mattress of FIG. 1 showing one portion thereof rotated relative to the other portion to provide access to a storage chest which forms the mattress support.

Referring now to FIG. 1, a mattress 10 is formed in two hinged portions 12 and 14. The mattress is supported by a chest 16 and abutted at one end to a headboard 18. As is illustrated in FIG. 2, the portions 12 and 14 are coupled together along a lateral hinge axis x—x which allows the lower portion 14 to be rotated or pivoted upwardly about the axis to uncover an access panel 20 in the top of the support chest 16.

Referring now to FIGS. 3–6, each base portion comprises a base section 12*a* or 14*a* of conventional inner spring and padding framework. The inner spring construction is formed by coil springs 22 connected together via framing wires 23.

An insulator pad or layer of cotton, felt or similar padding material 24 extends over the top, bottom and over at least a portion of the sides of the springs 22. The insulator pad is secured to the springs and framing wires via conventional hog ring clips (not shown). A sheet 26 of substantially nonstretchable fabric extends over the top and bottom insulator pads to substantially form a top and bottom surface for the base sections. It should be noted that the sheets 26 need not extend to the outer extent of the pads. Spaced cords or lines 28, which extend through the sheets 26 and the spring sections, are connected between buttons 30 to provide tufting and place the springs (or portions thereof) in compression in a conventional manner. The sheet 26 is preferably made of a nonwoven fabric such as Duon® Versare made by Amoco Inc. Each base section also includes a vertically oriented peripheral side wall 32 extending between the top and bottom surfaces. The peripheral side walls 32 define corresponding hingeable side walls 34 along one portion of the periphery of each base section.

A shell, preferably made of two pieces 36 and 38 (FIG. 6) connects the inner spring base sections 12*a* and 14*a* together via a hinge to be described.

Each shell portion 36 and 38 includes a bottom sheet 40 of substantially nonstretchable fabric and a peripheral skirt 42 which is arranged to extend upwardly and enclose the sides of a respective base section except for the hingeable side wall 34 thereof.

The skirt 42 is preferably formed of a quilted fabric for appearance reasons. The bottom sheet is preferably made of a water repellant vinyl such as Weblon® manufactured by Weblon, Inc. The bottom sheet (sometimes referred to as the "hinge sheet") performs the function of providing a hinge between the base sections in the assembled condition. To this end, the hinge sheet 40 includes an extension 40*a* which extends upwardly from the bottom of each shell along the hingeable side wall of a respective base section (in the assembled condition). The hinge sheets are sewn together along line 44 to form a hinge along the hinge axis x—x. Each piece of the hinge sheet preferably includes a flap 40*b* which extends beyond the hinge axis for providing reinforcement for the hinge as will be explained.

The shells 36 and 38, when sewn together along the hinge axis, are open at the top and define a pair of pockets bounded by the bottom or hinge sheet 40, the extension 40*a* and the peripheral skirt 42.

The base sections 12*a* and 14*a* are inserted into the pockets 46 during the assembly of the mattress. The hinge reinforcing flap 40*b* of each hinge sheet is then preferably secured to the top sheet 26 of a respective section by first sewing (or otherwise suitably securing) the free end of each flap to a strip 48 of substantially nonstretchable fabric which, in turn, is secured, e.g. by glue, to the top sheet 26 of a respective base section. The flaps 40*b*, when secured to the top sheets, serve to reinforce the hinge. The fabric strips 48 may be made of Typar® distributed by Remay, Inc.

The hinge sheet 40 (and the extension or reinforcing flap 40*b*), when made of a water repellant fabric, such as Weblon®, desirable for the marine environment, is not readily susceptible to the formation of a glue bond, thus the use of the securing strip 48. A small portion of the skirt 42, which is folded back across the hingeable side sections, may extend over the top edge portion of base sections as is shown in FIG. 3.

To eliminate the unsightly line depression resulting from the hinge, a hinge line cover sheet 50 of substantially nonstretchable fabric, such as Duon® Versare, is placed over the hinge reinforcing flap 40*b* and the attaching strips 48 during the assembly process. A strip 50*a* of the hinge line cover sheet 50, at free end 50*b*, is suitably secured to the top sheet 26 of one of the base sections, e.g., 14*a*, as by gluing, for example. Force is then applied to the other end 50*c* of the hinge line cover sheet to place the unglued portion of the sheet, including the segment thereof which overlies the hinge axis, in tension. While the sheet is under stress, a strip (comparable to strip 50*a*) at end 50*c* is also secured, as by gluing, to the top sheet 36 of the other base section, e.g., 12*a*. When constructed in this manner, a central segment of the hinge line cover sheet, which extends over the hinge axis, remains substantially coplanar with the free ends of the cover sheet when the base sections 12*a* and 14*a* are in their normal horizontal position. The hinge line cover fabric 50 extends substantially the entire lateral extent of the hinge axis as is illustrated in FIG. 3. The length "l" of the hinge line cover sheet must be adequate to inhibit the formation of a hinge line depression during the use of the mattress. Material is wasted if the sheet is too long. I have found that a length within the range of about 8" to 24" is satisfactory. Preferably the hinge 28 line cover sheet 50 has a length of about 10" to 15". The glue down strip 50*a* preferably has a width "w" within the range of about 1" to 3" or more depending upon the length of the sheet.

Figure 3:
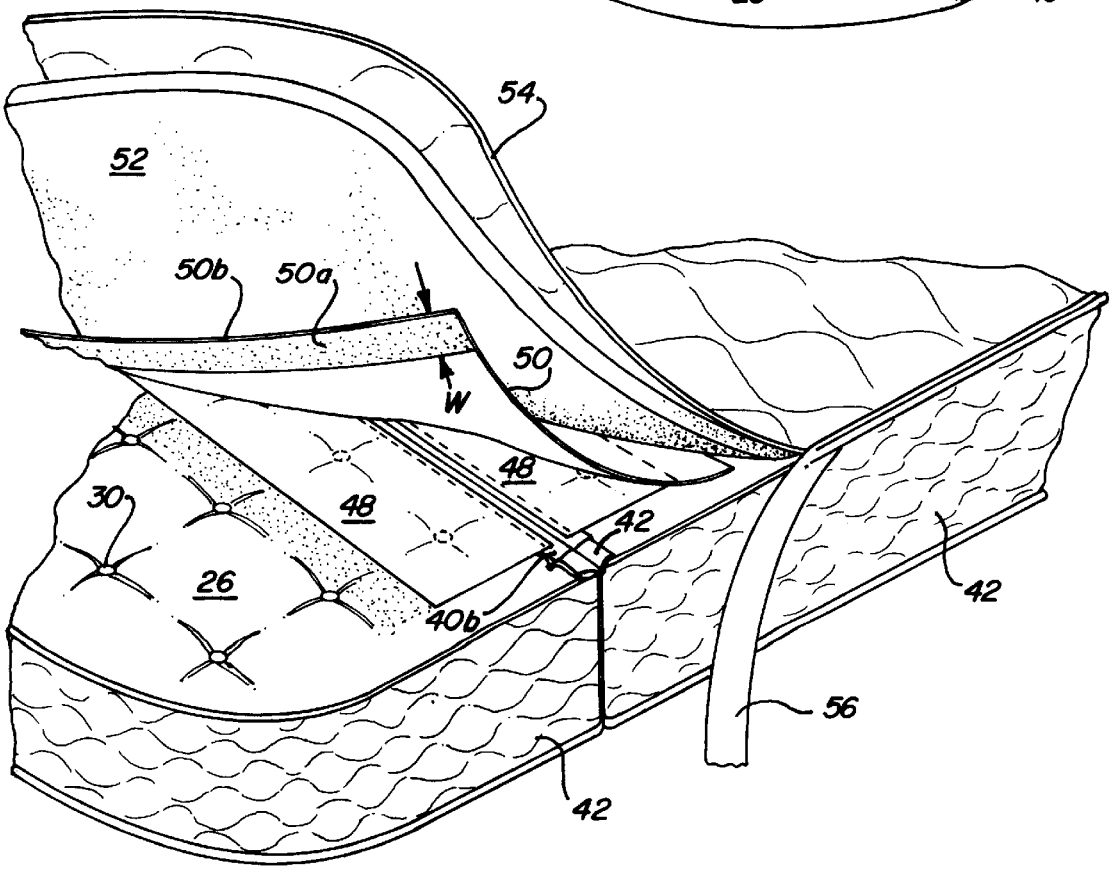
FIG. 3 is a partial exploded view of the top section of the mattress of FIG. 1.
Figure 4:
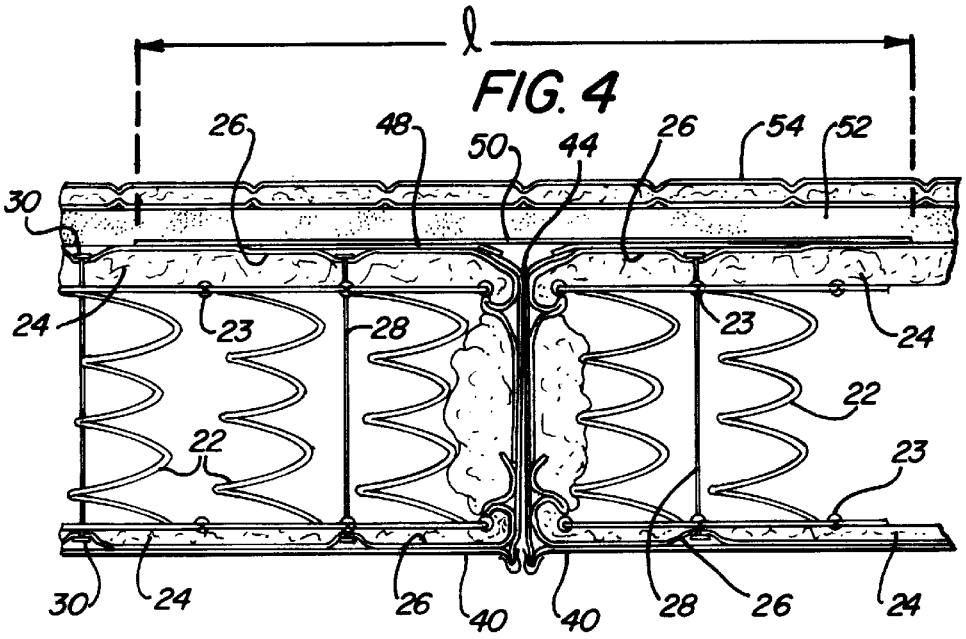
FIGS. 4 and 5 are cross-sectional views of a central section of the mattress of FIG. 1 showing the inner spring and hinge construction with the two portions in their normal coplanar position and one portion partially rotated relative to the other respectively.
Figure 5:
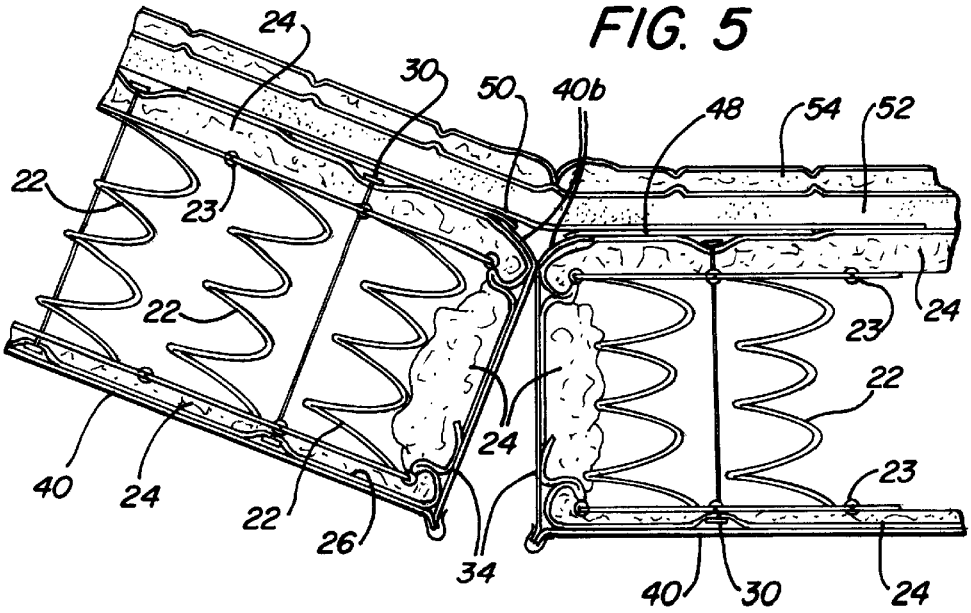
Figure 6:
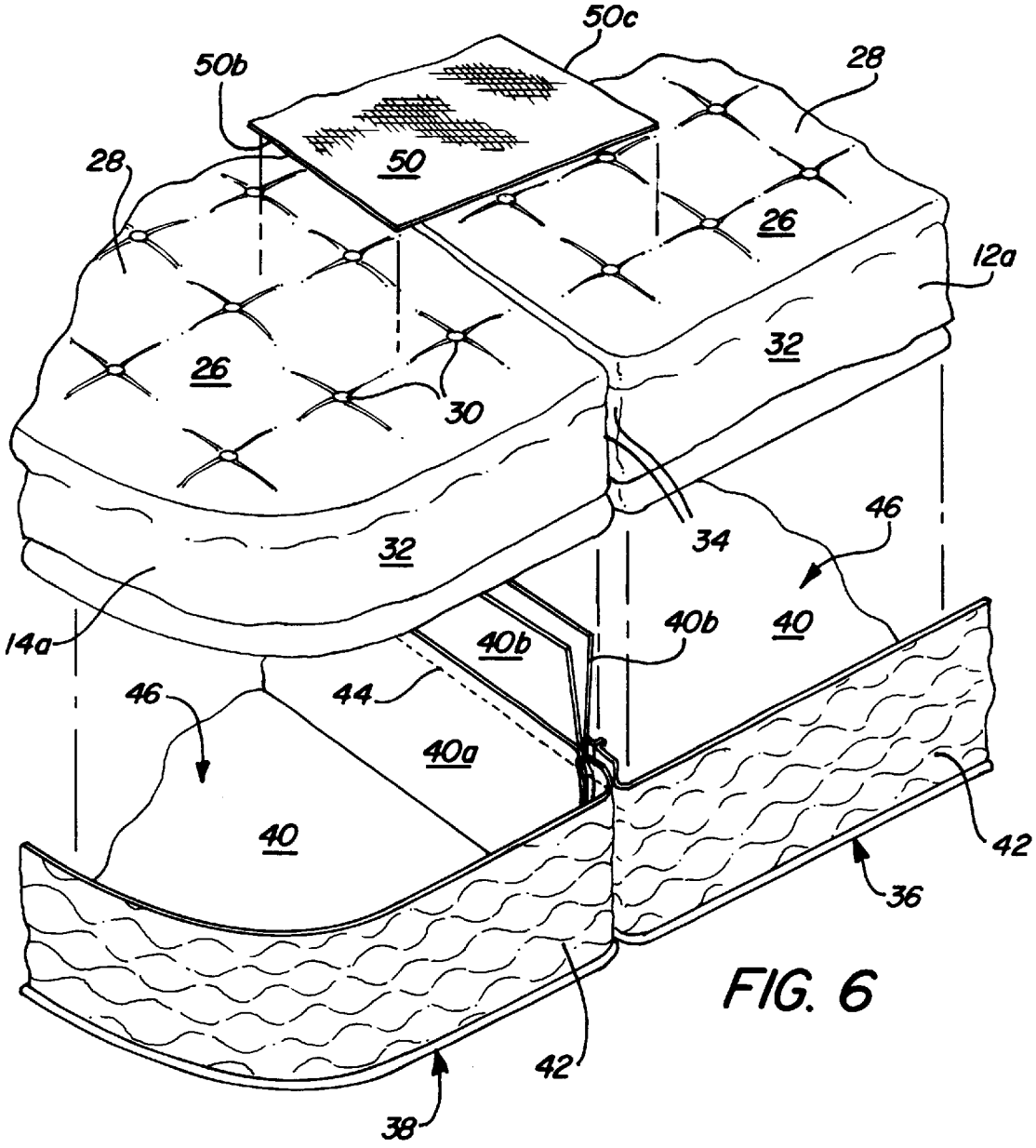
FIG. 6 is an exploded view of the mattress of FIG. 1, partially broken away, showing the method of construction.

To complete the mattress, a top layer 52 of foam or other suitable padding material may be placed over the top surfaces of the hinged base sections as is illustrated in FIG. 3. A quilted fabric 54 may then be placed over the layer 52 and secured, e.g., by sewing, to the upper periphery of the skirts 42 via a ribbing strip 56.

The mattress may be of any desired configuration and size. The hinge axis may extend laterally as is illustrated in FIG. 2 or longitudinally. Once the mattress has been placed on the supporting chest, the portion normally covering an access panel (such as panel 20, FIG. 2) in the chest may be readily pivoted to allow a user to store or remove items previously stored in the chest. In addition, the hinge simplifies the task of getting the mattress into or out of a boat or other marine vessel.

There has thus been described a novel hingeable innerspring mattress for use in the marine environment which conceals the hinge line and is simple to manufacture.

What is claimed is:

1. A hinged inner spring mattress comprising:

a pair of base sections, each base section having an inner spring and padding framework with top and bottom surfaces and an outside perimeter, each base section defining a hingeable side which lies substantially in a vertical plane when the top surface of the padding framework is oriented horizontally;

a shell extending along the bottom surface and outside perimeter of each base section, each shell including a hinge forming sheet of substantially nonstretchable fabric extending along the bottom surface and across a hingeable side section of each of the base sections, the hinge forming sheets forming a hinge along a hinge axis between the hingeable sides and adjacent the top surfaces of the base sections whereby one base section may be rotated about the hinge axis relative to the other one of the base sections from a normal position, wherein the top surfaces are coplanar, to a retracted position to provide access to an area below the rotated base section; and a hinge line cover sheet of substantially non-stretchable fabric extending along the top surfaces of the base sections over the hinge axis with free ends extending on each side of the hinge axis, the cover sheet being secured only at its free ends to the top surface of each base section with the central segment of the hinge line cover sheet in tension, so that this central segment of the cover sheet which extends over the hinge axis remains substantially coplanar with the free ends when the base sections are in their normal position.

2. The hinged mattress of claim 1 wherein the cover sheet extends at least five inches on each side of the hinge axis.

3. The hinged mattress of claim 2 wherein the cover sheet has a length "l" within a range of eight to twenty-four inches.

4. The hinged mattress of claim 2 wherein the cover sheet has a length "l" of about 10 to 15 inches.

5. The hinged mattress of claim 1 wherein the hinge forming sheet is formed of two fabric pieces joined together at the hinge axis.

6. The hinged mattress of claim 5 wherein each piece of the hinge forming sheet includes a free end extending beyond the hinge axis and secured to the top surface of a respective base section.

7. The hinged mattress of claim 6 wherein the cover sheet is secured at its free ends to the top surface of each base section in a parallel manner to the hinge axis.

8. The hinged mattress of claim 6 wherein the top and bottom surfaces of each base section have a length and a width and include another sheet of substantially nonstretchable fabric extending substantially along the length and width of said top and bottom surfaces surfaces with a plurality of cords extending between buttons positioned at spaced points along said another sheet to place the inner spring of each base section in compression.

9. The hinged mattress of claim 8 further including a cover secured to the shell along the upper periphery of the shell to enclose the top surfaces of the base sections.

10. A hinged inner spring mattress and support therefor comprising:

a chest for supporting the mattress, the chest having an access panel on one end therefor;

a pair of base sections positioned on the chest with one base section extending over the chest access panel, each base section having an inner spring and padding framework with top and bottom surfaces and peripheral side wall, the peripheral side walls of the base sections including corresponding hingeable side walls;

a pair of shell portions enclosing the bottom surfaces and side walls of the base sections, each shell portion having a hinge forming sheet of substantially nonstretchable fabric extending across the bottom surface and upwardly along the hingeable side wall of a respective base section, the hinge forming sheets being joined together along a hinge axis adjacent the top surfaces of the base sections, whereby one base section may be rotated about the hinge axis relative to the other base section from a normal position, wherein the top surfaces are coplanar, to a retracted position to uncover the access panel; and a hinge line cover sheet of substantially nonstretchable fabric extending along the top surfaces of the base sections and over the hinge axis with free ends extending on each side of the hinge axis, the cover sheet being secured at its free ends to the top surface of each base section in a parallel manner to the hinge axis with a central segment of the hinge line cover sheet in tension so that this central segment of the cover sheet which extends over the hinge axis is placed in tension when the base sections are coplanar.

11. The hinged mattress of claim 10 wherein the cover sheet extends at least five inches on each side of the hinge axis.

12. The hinged mattress of claim 11 wherein the cover sheet has a length within the range of eight to twenty-four inches.

13. The hinged mattress of claim 10 wherein the cover sheet has a length "l" which is about twenty inches.

14. The hinged mattress of claim 12 wherein each of the hinge forming sheets includes a free end extending beyond the hinge axis and secured to the top surface of a respective base section.

15. The invention of claim 14 wherein the top and bottom surfaces of each base section have a length and a width and include another sheet of substantially nonstretchable fabric extending substantially along the length and width of said top and bottom surfaces with a plurality of cords extending between buttons positioned at spaced points along said another sheet to place the inner spring of each base section in compression.

16. The hinged mattress of claim 15 wherein the shell haa an upper periphery and includes an upwardly extending skirt and further including a cover secured to the skirt along the upper periphery thereof to enclose the top surfaces of the base section.

* * * * *

UNITED STATES PATENT AND TRADEMARK OFFICE

CERTIFICATE OF CORRECTION

PATENT NO. : 6,088,857

DATED : July 18, 2000

INVENTOR(S) : David D. Ogle

It is certified that error appears in the above-indentified patent and that said Letters Patent is hereby corrected as shown below:

Column 3, line 44, "l" should read -- --.

Column 3, line 49, delete "28".

Column 4, line 65, "therefor" should read --thereof--.

Column 6, line 21, delete "haa" and insert --has--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*